US006581868B1

(12) United States Patent
Enwald et al.

(10) Patent No.: US 6,581,868 B1
(45) Date of Patent: Jun. 24, 2003

(54) METHOD AND DEVICE FOR TRANSFERRING A WEB ONTO A REEL SPOOL IN THE REEL-UP OF A PAPER WEB

(75) Inventors: Petri Enwald, Tuusala (FI); Seppo Luomi, Järvenpää (FI); Kaj Fabritius, Hyvinkää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/762,915

(22) PCT Filed: Jul. 30, 1999

(86) PCT No.: PCT/FI99/00644

§ 371 (c)(1),
(2), (4) Date: Feb. 9, 2001

(87) PCT Pub. No.: WO00/09433

PCT Pub. Date: Feb. 24, 2000

(30) Foreign Application Priority Data

Aug. 11, 1998 (FI) ..... 981732

(51) Int. Cl.[7] ..... B65H 35/10
(52) U.S. Cl. ..... 242/521; 242/908; 162/193
(58) Field of Search ..... 242/521, 532.2, 242/908, 526, 529, FOR 197; 162/193

(56) References Cited

U.S. PATENT DOCUMENTS

| | | | | | |
|---|---|---|---|---|---|
| 3,845,914 | A | | 11/1974 | Straujups | 242/56 R |
| 4,147,287 | A | * | 4/1979 | Reba | 226/7 |
| 4,445,646 | A | * | 5/1984 | Karr et al. | 242/521 |
| 5,441,211 | A | | 8/1995 | Ueda et al. | 242/256.1 |
| 5,635,030 | A | | 6/1997 | Meschenmoser | 162/193 |
| 5,901,917 | A | | 5/1999 | Schmidt et al. | 242/521 |
| 6,029,927 | A | * | 2/2000 | Wohlfahrt et al. | 242/527.2 |
| 6,322,587 | B1 | * | 11/2001 | Quiachon et al. | 606/195 |

FOREIGN PATENT DOCUMENTS

| | | | | |
|---|---|---|---|---|
| DE | 19542096 | | 10/1996 | B65H/19/28 |
| EP | 0543788 | | 5/1993 | B65H/19/26 |
| EP | 0088713 | | 9/1993 | B65H/19/22 |
| GB | 1041364 | B1 * | 9/1966 | |
| JP | 10175759 | | 6/1998 | B65H/19/26 |

* cited by examiner

*Primary Examiner*—Donald P. Walsh
*Assistant Examiner*—Mark J. Beauchaine
(74) *Attorney, Agent, or Firm*—Steinberg & Raskin, P.C.

(57) ABSTRACT

The present invention relates to a method and device for the transferring of a web onto a reel spool in the reel-up of a paper web having an empty reel spool (2) that is introduced into a contact with the web (W) running on the reeling cylinder (1) and being still unreeled, to make the transfer possible, and a turn-up blow is used to help the web (W) to break and to be guided on to the empty reel spool (2). The turn-up blow is brought from beneath a horizontal plane passing through the central axis of the reeling cylinder (1) into a location on the mantle of the reeling cylinder that is located after the reel spool (2) in the direction of rotation of the reeling cylinder.

12 Claims, 2 Drawing Sheets

METHOD AND DEVICE FOR TRANSFERRING A WEB ONTO A REEL SPOOL IN THE REEL-UP OF A PAPER WEB

FIELD OF THE INVENTION

The present invention relates to a method for transferring a web in the reel-up of a paper web. The present invention also relates to a device for transferring a web in the reel-up of a paper web.

BACKGROUND OF THE INVENTION

A reel change in the reel-up of a paper web is made in a known manner by cutting the web traveling to an old reel being completed and by guiding the web around a new reel spool previously brought into contact with the web and forming the core for a new reel. For performing the cutting and for guiding the web around the new reel spool, air blows are generally used, wherein mechanical cutting of the web in part or in full width can be used as an aid. With thin paper grades, a blow from below the web or from the side of the web is often sufficient to penetrate and cut the web.

The above-described measures are taken during the run when a continuous paper web coming from preceding machine sections is being reeled up, wherein the change sequence is performed each time the reel is completed. Before starting the run with said repeated reel changes, the paper web must be transferred for the first time around an empty reel spool in a so-called turn-up blow. Before the turn-up blow, the web is run in its full width through the reeling cylinder to the pulper. The turn-up blow is executed with an overlying blowing device, a so-called gooseneck, which is brought by a suitable turning mechanism from above down in such a way that the blow nozzle points at the surface of the reeling cylinder, on top of which the web is running to the pulper. The gooseneck is brought to the operating position in such a way that the nozzle points at the surface of the reeling cylinder after a nip between the empty reel spool and the reeling cylinder. The web on the reeling cylinder is torn by the air blow, and air is guided under the web to lift the web to wind up around the empty reel spool. On both sides of the tearing point, the web is torn to the edges, and the new leading end of the web follows the reel spool.

The gooseneck used as the turn-up blow device is relatively complex and requires several pivotal movements, a pressurized air container of its own and its respective valves. Moreover, the gooseneck with its turning mechanisms require space above the reeling cylinder.

OBJECT AND SUMMARY OF THE INVENTION

It is an aim of the present invention to eliminate the above-mentioned drawbacks and to present a novel method for transferring the web onto the reel spool by the so-called turn-up blow. It is an aim of the method to replace the gooseneck which has been previously used as the turn-up blow device. It is another aim of the invention to make the space utilization in the reel-up more efficient. It is also an aim of the invention to make it possible to select the location of the reel spool more freely in the turn-up blow, because the gooseneck has previously determined the location of the reel spool at least in the respect that the reel spool must have been in a sufficiently high position for the gooseneck to reach around it down below it. The transfer is effected in the invention by an air blow brought from below. Thus, the air blow pipes can be placed in the same structure in which change blow pipes are normally used during reel change sequences. In other respects, the transfer of the web can be fully effected by the same principles and the same auxiliary methods.

It is also an aim of the invention to present a device for transferring the web onto the reel spool. The air channel for effecting the turn-up blow is brought from below to an operative connection with the reeling cylinder. The air channel can be placed in the same structure as the change blow pipes, wherein one or several change blow pipes can be replaced with one or several turn-up blow pipes, respectively, or turn-up blow pipes can be added next to existing change blow pipes. It is also possible to use the same change blow pipes, turnable to a different position than in the change situation, as turn-up blow pipes.

BRIEF DESCRIPTION OF THE DRAWINGS

In the following, the invention will be described in more detail with reference to the appended drawings, in which.

DETAILED DESCRIPTION OF THE INVENTION

Figure 1:
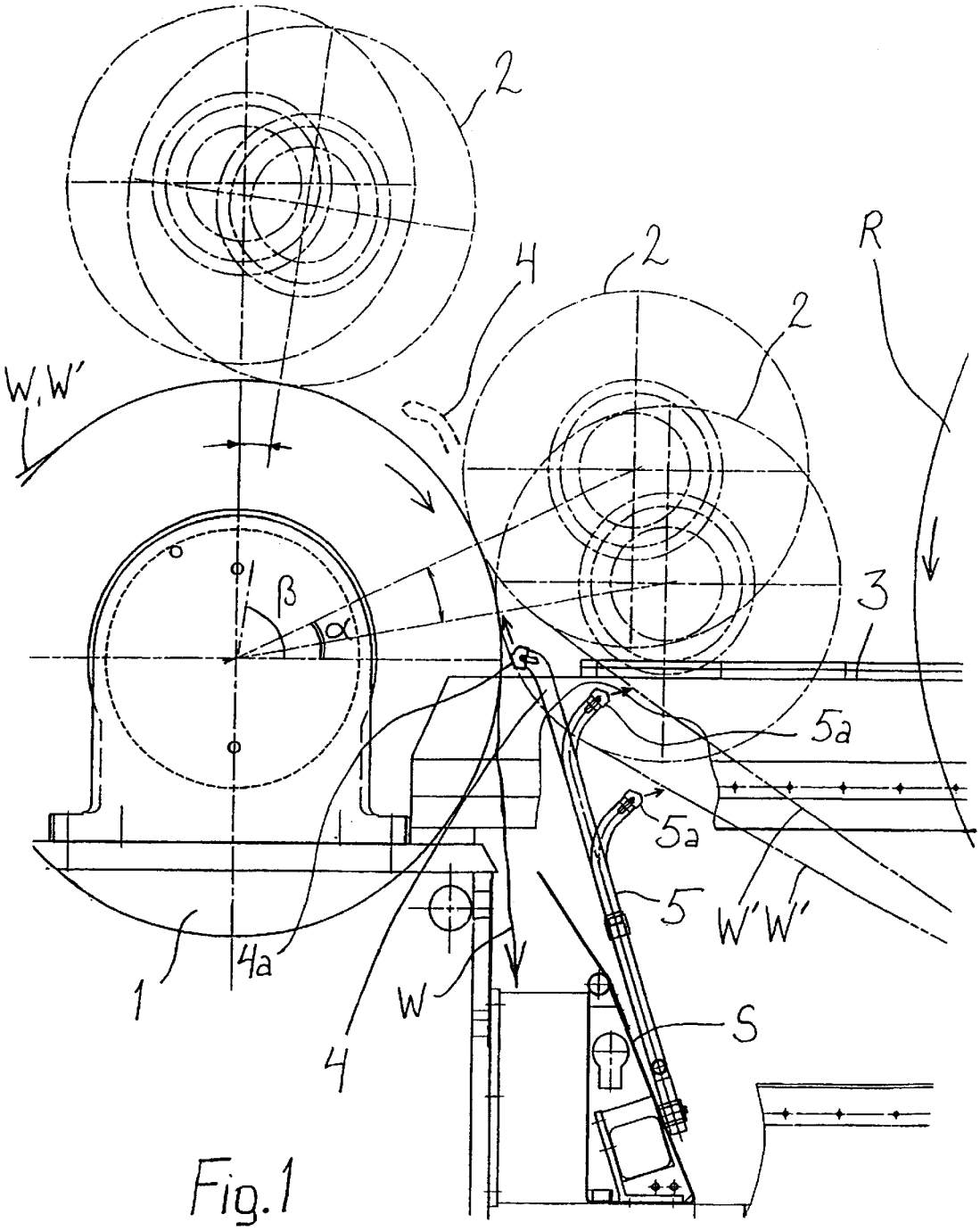
FIG. 1 shows a reel-up comprising a turn-up blow device in a side view.

FIG. 1 shows a part of the reel-up for a paper web, namely a reeling cylinder 1 which guides the continuous paper web W', which comes from previous machine sections at the end of the paper machine or an after-treatment machine for paper and normally has a width of several metres, to a reel spool 2. The reeling takes place in a way known as such so that the reeling cylinder 1 is in contact with the reel spool via a reeling nip. The reel spool is loaded towards the reeling cylinder by a loading mechanism known as such, and at the same time a reel spool forming the core of the reel is supported in a suitable support structure, such as on reeling rails 3. The reel-up is designed to operate continuously to reel successive paper reels around successive reel spools brought to the reeling position. The full machine reels have typically a weight exceeding 10 tonnes.

FIG. 1 shows a situation in which the web W indicated with an un-broken line is not yet reeled up on a reel to form a so-called machine reel, but it travels in a certain sector on the reeling cylinder 1 and is disengaged from the same as a full-width web to form broke. The figure shows how the web falls from the reeling cylinder down to the pulper. Letter S indicates a pulper shield located in the transverse direction across the width of the web and limiting the inlet opening of the pulper after the opening when seen in the longitudinal direction of the machine. This situation is in the reel-up e.g. after threading, in which a lead-in strip or tail is first brought through the nip between the reeling cylinder 1 and a still empty reel spool 2 to travel down to the pulper, after which the web is spread to its full width by diagonal cutting in the preceding machine sections.

FIG. 1 shows, by a line of dots and dashes, several possible locations of the reel spool 2 on the perimeter of the reeling cylinder 1. The empty reel spool 2 can be brought to a position which makes it possible to transfer the web. The reel spool is in this position at a suitable location on the circumference of the reeling cylinder 1 in contact with the web W travelling on the reeling cylinder 1. In principle, the transfer by the turn-up blow onto the reel spool 2 can be made at any location on the perimeter of the reeling cylinder, but with respect to the invention, it is preferably made when this contact point, i.e. the nip between the reel spool 2 and the reeling cylinder 1, is at an angular distance of 0 to 90° against the rotating direction of the reeling cylinder from the horizontal plane passing through the central axis of the reeling cylinder. The web must thus wrap around the reeling cylinder sufficiently to maintain the web tension.

An air channel, i.e. a turn-up blow pipe 4, is introduced in an inclined position from below said horizontal plane towards the reeling cylinder. This blow pipe extends approximately towards the nip between the reeling cylinder 1 and the empty reel spool 2. At the end of the blow pipe there is a curve which turns the direction of the blow pipe more towards the reeling cylinder 1, and at the outermost end of the pipe there is a nozzle structure 4*a* directed towards the mantle surface of the reeling cylinder 1. The nozzle opening of the nozzle structure is located sufficiently close to the reeling cylinder 1 and the empty reel spool 2 in the opening gap therebetween in a space which is limited by the mantle of the reeling cylinder 1, by the mantle of the empty reel spool 2 and, in the introducing direction of the blow pipe, by the common tangent of the mantle surfaces of the reeling cylinder 1 and the reel spool 2. The figure shows a situation in which the empty reel spool 2 is located at an angle distance of ca. 25° from the horizontal plane. The turn-up blow pipe 4 is placed in such a way that the nozzle opening of the nozzle structure 4*a* is directed against the direction of the web W running on the surface of the reeling cylinder after said nip so that the blow from the opening (arrow) is approximately parallel to the tangent of the reeling cylinder sector extending between the nip and the mantle point closest to the nozzle opening. The air blow strips the web W off the surface of the reeling cylinder and guides it around the empty reel spool 2. The principle of threading is thus the same as in gooseneck threading, but the significant difference lies in that the gooseneck does not need to be brought from above but it is possible to use a turn-up blow pipe brought from below and having a simpler structure and simpler movements. Consequently, the reel-up shown in the drawing can thus totally exclude a gooseneck as a threading device to be turned from above down. A rigid turn-up blow pipe 4 acts simultaneously as an air channel and a support structure for the nozzle structure 4*a*.

Another difference to previous transfer situations in the situation shown by the drawing is that it is advantageous to apply the turn-up blow when the nip between the reel spool and the reeling cylinder is relatively close to the horizontal plane, e.g. advantageously at an angular distance of less than 45°, preferably less than 30°, from the horizontal plane. In the situation shown in the figure, the angular distance $\alpha$ is ca. 25° However, the invention is not limited to the position in which the transfer is made. If the turn-up blow pipe 4 is arranged to have such a structure that the nozzle structure 4*a* can be lifted from below to a sufficiently high position, the transfer can, in principle, be made also in the upper position shown by broken lines in the drawing, wherein the angular distance $\beta$ is approximately 80°. The location of the end of the blow pipe in this situation is indicated with broken lines.

Structurally, the invention can be implemented by fixing the turn-up blow pipe 4 at the same location where the known change blow pipes for effecting the change blow from below are fixed. These change blow pipes are indicated in the figure by reference numerals 5 and the nozzle structures at their ends with the reference numeral 5*a*. An arrow indicates the change blow which comes from the nozzle openings of the nozzle structures of the change blow pipes and is directed in the direction of rotation of the surface of the reel spool towards the run of the web W disengaging from the reel spool.

The turn-up blow pipes 4 can thus be fixed on the opposite side of the pulper shield S, seen from the pulper opening, that is, in the same structure with the change blow pipes 5. Thus, they can be similarly arranged to be pivoted from below up into a functional position, the plane of pivotal movement being located in the transverse direction of the machine and being at the same time inclined towards the reeling cylinder. There can be one or more turn-up blow pipes 4 spaced from each other in the transverse direction of the machine, wherein they operate on one or several locations in the width direction of the web, respectively. Similarly, part of the change blow pipes 5 can be replaced by turn-up blow pipes 4 to be placed in the same location, or one or several turn-up blow pipes 4 are placed in suitable locations next to already existing change blow pipes 5. The change blow pipes and one or several turn-up blow pipes can be coupled to the same source of pressurized air.

Also the idea that the turn-up blow pipe 4 can be used as a change blow pipe 5 falls within the scope of the invention. Thus, the nozzle structure 4*a* at the end must be turnable in such a way that instead of pointing to the reeling cylinder it points to the approximately opposite direction, i.e. towards the run of the web disengaging from the mantle of the empty reel spool 2 after having travelled thereon in a short sector. This can be effected by arranging the turn-up blow pipe rotatable around its longitudinal axis so that the direction of the nozzle structure at its end and consequently the direction of blow is changed. It is also advantageous that the position of the nozzle structure at the end can be changed so that the air blow from the nozzle opening is directed optimally with respect to the run of the web. Consequently, the end of a conventional pipe is preferably arranged to be flexible, wherein it is possible to change the direction of the nozzle structure 4*a* and, correspondingly, the direction of the nozzle opening. Using such a turn-up blow pipe, it is also easier to effect the transfer irrespective of the position of the empty reel spool 2 on the perimeter of the reeling cylinder 1, as in the upper position of FIG. 1.

Naturally, there are several alternative structures for the turn-up blow pipe 4. It can be arranged to be adjustable in its length, wherein its height position can be adjusted according to the transfer location. Similarly, the distance of the nozzle structure 4*a* from the mantle of the reeling cylinder 1 may be adjustable e.g. in such a way that part of the blow pipe or the whole blow pipe is slightly pivotable in the machine direction. For this purpose, the end of the blow pipe can be arranged flexible in the above-described manner. Thus, it is possible to adjust the blowing direction so that the blow is directed at a desired acute angle to the tangent of the reeling cylinder against the rotating direction of the reeling cylinder towards the mantle of the reeling cylinder in the area following the nip. The blow direction is selected so that the blow is directed at a suitable angle under the web, lifting the web off the reeling cylinder.

Naturally, it is possible to use several auxiliary devices which facilitate the disengaging of the web from the reeling cylinder. These can be various incisive cutting blades which may be fixed to the turn-up blow pipe so that the cut will be made after the nip before the point of impact of the blow to the reeling cylinder 1. These may also be separate devices before the nip, for example before the location at which the web W comes onto the mantle of the reeling cylinder 1.

FIG. 1 also shows a change situation which is applied when the reel is completed around the reel spool 2. In the change situation, the empty reel spool 2 can be in the same positions, shown by broken lines, as in the turn-up blow situation, where the formation of the first reel is just being started. The figure shows two change situations in which the web W' is passed after the nip onto the mantle surface of the reel spool 2 introduced to the change position. The web travels after the nip in a short sector on the mantle of the reel spool 2 and is disengaged therefrom towards the reel R being completed and having been brought further in the support structure 3 before the change. The travel of the web W' in these change situations is also shown by broken lines. Located at the end of the change blow pipe 5 introduced from below, the nozzle structure 5*a* is directed after said disengaging point towards the web W'. The blows can be directed towards the free mantle surface of the reel spool 2 on the other side of the path of the web W', tangentially to the same or past the same in the direction of rotation of the free mantle surface, and they guide the web W' around the empty reel spool 2 in the change situation.

Figure 2:
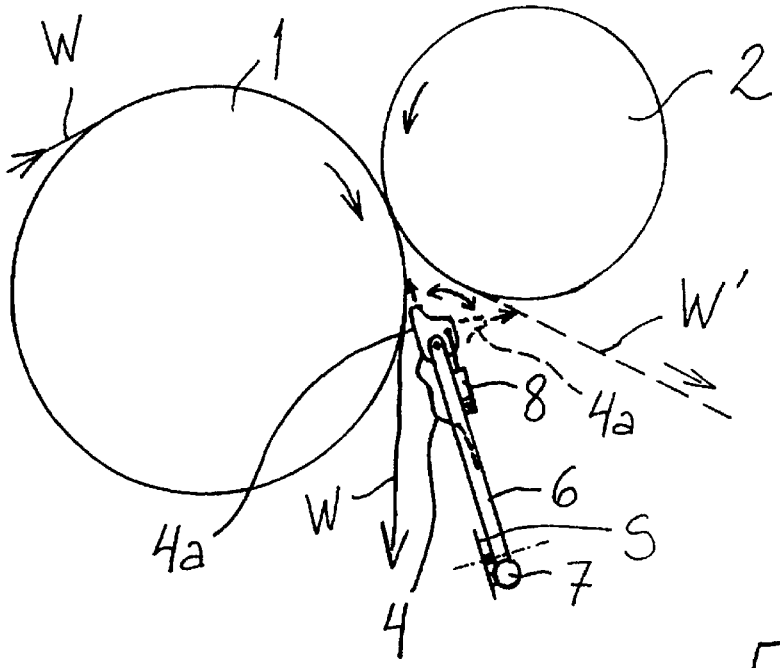
FIG. 2 shows a turn-up blow device according to a preferred embodiment.

FIG. 2 shows one possibility to perform both the turn-up blow and the change blow with the same device. The device has an elongated frame 6 which is directed towards the nip and which can be turned to the operational position in the transverse direction from below up by a lifting actuator 7. On the nip side of the frame, there is a nozzle structure 4*a* pivotally connected to the frame to be pivotable in the machine direction. In the position directed towards the nip, the nozzle structure 4*a* performs the turn-up blow and in the position turned further to the machine direction (broken lines) performs the change blow. For the purpose of illustrating both functions, the location of the reel spool 2 is shown both in the turn-up blow situation and in the change blow situation, although both of the situations do not exist at the same time. Furthermore, it is possible that the location of the reel spool 2 is not the same in these situations. To have always the best location and position of the nozzle structure 4*a* for each situation, the possibilities of moving the nozzle structure 4*a* can be increased by arranging the frame 6 to be variable in its length, for example telescopically, and/or pivotable in the machine direction. The air channel 4 is in this case introduced as a flexible air hose, at least over the length making the turning movement of the nozzle structure 4*a* possible. An actuator turning the nozzle structure 4*a* and fixed at its one end to the frame 6 is indicated with the reference numeral 8.

There can be several pivotable frames 6 of FIG. 2 in parallel at suitable intervals, wherein the turn-up blow and, in a corresponding manner, the change blow can be effected at several locations in the transverse direction, i.e. the width direction of the web W, W'.

Figure 3:
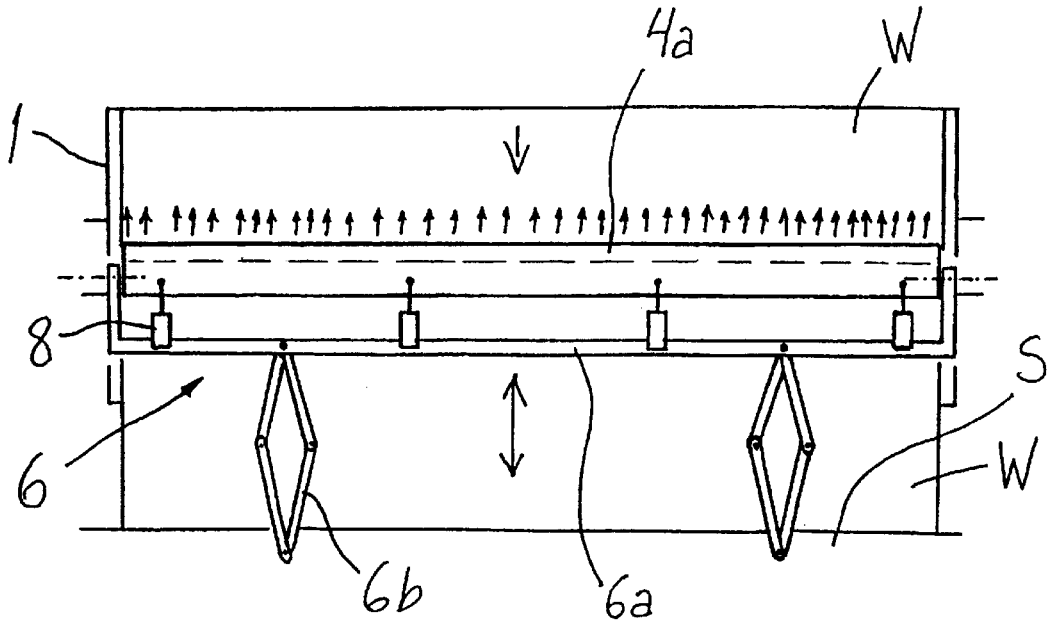
FIG. 3 shows a turn-up blow device according to another preferred embodiment.

Furthermore, FIG. 3 shows, as seen in the machine direction, a device with a continuous nozzle structure 4*a* extending across a large part of the width of the machine. This nozzle structure can extend preferably across more than a half of the width of the web W, or, as shown in FIG. 3, across the whole width of the web. The function of the nozzle structure 4*a* can be, in principle, similar to that shown in the side view of FIG. 2, that is, it is pivotally connected to on the support structure to be pivotable in the machine direction. Due to the width of the nozzle structure 4*a*, however, the frame 6 has a different structure; that is, here the upper part of the frame has a U-shaped support 6*a* to whose legs the ends of the nozzle structure 4*a* are pivotally connected, and the lower part is provided with two or more lifting devices 6*b* which are arranged to lift the support 6*a* and therewith the nozzle structure 4*a* directly from below up. The lifting devices 6*b* shown in FIG. 3 function on the "articulated jack" principle, and they can be moved by known actuators, such as pneumatic or hydraulic cylinders (not shown). The actuators which make the pivotal movement of the nozzle structure 4*a* possible in the machine direction and which are fixed at one end to the support 6*a* are indicated with the reference numeral 8.

The air outlet of the nozzle structure 4*a* can be formed of a series of adjacent nozzle slots or nozzle openings spaced at sufficiently small intervals, or it can also be a single slot extending over the full width. The structure makes a uniform turn-up blow or change blow possible over a large part of the width of the web W, e.g. over the full width of the web, as shown in FIG. 3.

The method is suitable for all paper webs, and the need to use auxiliary means to assist in the breaking of the web depends on the paper grade and on the grammage. Similarly, the term paper web is used to refer, irrespective of its grammage, to all continuous webs formed of a fibrous raw material, in whose threading the above-described principle and device with possible auxiliary means can be applied.

What is claimed is:

1. A device for transferring a paper web onto a reel spool in a reel-up of a paper web, comprising:

a reeling cylinder (1) structured and arranged to be rotatable around a center axis, said reeling cylinder (1) being structured and arranged to guide the paper web (W) on a mantle thereof, means for bringing an empty reel spool (2) into contact with the paper web (W) running on the mantle of the reeling cylinder (1) to thereby make the transfer possible, a support frame structured and arranged to be movable into an operating position, said support frame having:

a nozzle structure (4*a*) operatively coupled to an end thereof; and an air channel (4) structured and arranged to supply air to said nozzle structure (4*a*); said nozzle structure (4*a*) being directed towards the mantle of the reeling cylinder and located after the empty reel spool (2) in the direction of rotation of the reeling cylinder (1), said nozzle structure (4*a*) being structured and arranged to effect a transfer of said web (W) from said reeling cylinder (1) to said reel spool (2) by effectuating a turn-up blow on said mantle of said reeling cylinder (1), wherein when said support frame is in the operational position, the support frame and the air channel (4) supplying air to the nozzle structure are brought from below a horizontal plane passing through the central axis of the reeling cylinder, to the vicinity of the mantle of the reeling cylinder (1).

2. A device according to claim 1 wherein the frame is arranged pivotable from below up to the operational position.

3. A device according to claim 1 wherein the frame is fixed to a pulper shield (S) located after the pulper opening.

4. A device according to claim 1 further comprising there are two or more parallel frames at different locations in the transverse direction of the machine.

5. A device according to claim 1 wherein the nozzle structure (4*a*) at the end of the air channel is arranged pivotable away from the reeling cylinder (1) into a change blow position to change the web (W') running onto a reel (R) being completed to run to an empty reel spool (2) brought to the change position.

6. A device according to claim 5, wherein the nozzle structure (4*a*) is pivotable with respect to the frame.

7. A device according to claim 5, wherein the frame supporting the nozzle structure (4*a*) is rotatable around its longitudinal axis.

8. A device according to claim 1 wherein that the frame is a blow pipe forming the air channel (4).

9. A device according to claim 1 wherein the air channel is brought to the nozzle structure (4*a*) separately from the frame (6) supporting the nozzle structure (4*a*).

10. A method for transferring a web onto a reel spool in a reel-up of a paper web, comprising the steps of:

providing a reeling cylinder (1), wherein said web is run over said reeling cylinder rotating around a central axis and said web being unreeled;

providing an empty reel spool (2);

bringing said empty reel spool (2) into contact with said web (W); and providing a turn-up blowing onto said web for breaking said web and for guiding said web onto said empty reel spool (2), wherein said turn-up blowing is introduced from beneath a horizontal plane passing through the central axis of said reeling cylinder (1) and is effectuated on a portion of the mantle of said reeling cylinder located after said contact point with said empty reel spool (2) in a direction of rotation of said reeling cylinder.

11. The method according to claim 10, further comprising the step of:

transferring said web from said reeling cylinder (1) to said empty reel spool (2) located at an angular distance of less than 45° as measured against the direction of rotation of the reeling cylinder (1) from a horizontal plane passing through a central axis of said reeling cylinder (1).

12. The method according to claim 10, further comprising the step of:

simultaneously introducing at least two parallel turn-up blowings from below to thereby guide said web (W) around said reel spool (2) onto at least two locations along a width of said web.

* * * * *

UNITED STATES PATENT AND TRADEMARK OFFICE

CERTIFICATE OF CORRECTION

PATENT NO. : 6,581,868 B1
DATED : June 24, 2003
INVENTOR(S) : Enwald et al.

It is certified that error appears in the above-identified patent and that said Letters Patent is hereby corrected as shown below:

Title page,
Item [75], Inventor, should read -- Petri Enwald, Tuusula, FL --

Signed and Sealed this

Seventh Day of October, 2003

JAMES E. ROGAN
*Director of the United States Patent and Trademark Office*